United States Patent [19]

Stahler

[11] Patent Number: 4,880,045

[45] Date of Patent: Nov. 14, 1989

[54] WINDOW SHADE ASSEMBLY

[76] Inventor: Deborah L. Stahler, 801 Lear, New Lenox, Ill. 60451

[21] Appl. No.: 169,978

[22] Filed: Mar. 18, 1988

[51] Int. Cl.[4] ..... E06B 3/94

[52] U.S. Cl. ..... 160/84.1; 160/207

[58] Field of Search ..... 160/84.1, 207, 282, 160/285

[56] References Cited

U.S. PATENT DOCUMENTS

| | | | |
|---|---|---|---|
| 604,329 | 5/1898 | Judge | 160/115 |
| 1,433,227 | 10/1922 | Radar | 160/282 |
| 2,754,900 | 7/1956 | Karobonik et al. | 160/84.1 X |
| 3,375,818 | 4/1968 | Luther | 160/84.1 X |
| 4,665,964 | 5/1987 | Zommers | 160/84.1 |

FOREIGN PATENT DOCUMENTS

| | | | |
|---|---|---|---|
| 10060 | of 1902 | United Kingdom | 160/282 |
| 370176 | 4/1932 | United Kingdom | 160/84.1 |

*Primary Examiner*—Blair M. Johnson

*Attorney, Agent, or Firm*—Wood, Dalton, Phillips Mason & Rowe

[57] ABSTRACT

A window shade assembly including a flexible window shade and a pair of guide tracks adapted to receive and support the window shade. The flexible window shade is sized to cover a window and formed to have a plurality of pleats therein. Each of the pleats is defined by a first fold portion and a second fold portion which together form a double fold. The flexible window shade is also formed to have the pleats substantially from one end to the other end thereof. The pair of guide tracks is adapted to be fixedly mounted to a frame of the window in spaced parallel relation. Each of the guide tracks is mounted to extend generally perpendicular to the longitudinal direction of the pleats. The guide tracks also are adapted to be spaced by a distance sufficient for positioning the pleats therebetween. By utilizing spring-biased rollers or non-rotational sliders and loose-fitting slide members, the flexible window shade can be moved in accordianlike fashion.

28 Claims, 3 Drawing Sheets

WINDOW SHADE ASSEMBLY

FIELD OF THE INVENTION

The present invention is directed to window coverings and, more particularly, to a window shade assembly for positioning in infinitely variable positions.

BACKGROUND OF THE INVENTION

Over the years, many different types of window coverings have been proposed. It is generally recognized that window coverings of one type or another are desirable for a wide variety of reasons including privacy, aesthetics, and environmental, i.e., to soften or eliminate the influx of sunlight in daytime and to help in terms of heating and cooling requirements by establishing an additional thermal barrier. For these purposes, curtains, blinds and shades have experienced widespread utilization.

Generally speaking, it has been thought that such curtains, blinds and shades are satisfactory in most respects. They do, for instance, accomplish the functions of affording privacy, providing aesthetic window treatments, and, in some instances, accomplishing environmental objectives. Nevertheless, they have been found lacking in the degree of versatility that would be considered desirable in a most important respect.

Specifically, it has generally been recognized, especially with regard to window shades, that they must be mounted at the top of a window. This, of course, is also true for blinds and curtains which, similarly, are mounted at the top of a window and, in the case of window shades and blinds, intended to be raised and lowered relative to the top of the window for opening and closing purposes, respectively. As a result, there has been no window treatment available which has departed to any significant extent from what is regarded by most to be a conventional mounting.

In this connection, it is generally recognized that it would be desirable to have a window covering that could be placed in an infinite variety of positions. For instance, it might be desirable, depending upon window placement, to be able to cover a lower half of a window by means of a shade or the like whereby the top sash could be lowered for ventilation purposes while still giving the requisite degree of privacy. Also, based upon the position of the sun, it might be desirable to cover a midportion of a window to block the sun but to otherwise not obscure the view from the window.

In any event, this has simply been impossible to achieve in an entirely satisfactory fashion with any of the conventional window treatments that have been available to the consuming public. This relates principally to the fact that such window treatments have consistently been designed to be mounted at the top of a window and, thus, can only operate so as to be opened in a single direction and, of course, are severely limited in terms of the portion and degree of the window that can be obscured thereby. In an attempt to overcome these problems, Judge U.S. Pat. No. 604,329 proposes a window shade that is mounted relative to the side frame of a window.

Unfortunately, the Judge '329 window shade would essentially be inoperative since it was designed in a manner where it would be nearly impossible to operate. It utilized roller tension devices associated with every one of a plurality of rigid, hinged slats that cooperate with side mounted tracks. With this arrangement, it would be necessary to individually move every one of the roller tension devices to reposition the window shade.

In view of the foregoing, it is a principal object of the present invention to provide a window shade assembly that effectively and efficiently permits an essentially infinite positioning in relation to a window.

SUMMARY OF THE INVENTION

Accordingly, the present invention is directed to a window shade assembly having a flexible window shade and a pair of guide tracks adapted to receive and support the window shade so as to be placed in any position relative thereto. The flexible window shade is sized to cover a window and formed to have a plurality of pleats therein. Each of the pleats is defined by a first fold portion and a second fold portion which together form a double fold. The flexible window shade is formed to have the pleats substantially from one end to the other end thereof. The pair of guide tracks is adapted to be fixedly mounted to a frame of the window in spaced parallel relation. Each of the guide tracks is to extend generally perpendicular to the longitudinal direction of the pleats. The guide tracks also are adapted to be spaced by a distance sufficient for positioning the pleats therebetween. By utilizing retention means associated with the ends of the flexible window shade and slide means associated with non-projectable fold lines therebetween, it is possible to position the window shade in an infinite variety of positions.

More particularly, each of the pleats preferably has a projectable fold line between the first and second fold portions forming the double fold thereof. The projectable fold line is moveable from a position generally corresponding to a plane defined by the guide tracks when the flexible window shade is closed to cover the window to positions gradually increasing in distance therefrom to a maximum projecting position as the flexible window shade is opened to most fully reveal the window. Further, each of the pleats also is preferably integrally associated by means of one of the non-projectable fold lines with the next adjacent of the pleats.

With this construction, the retention means are associated with the ends of the flexible window shade. Advantageously, the retention means are adapted to cooperate with the guide tracks to maintain the ends of the flexible window shade in any selected position of adjustment relative to the guide tracks. Additionally, the slide means are associated with opposite ends of the non-projectable fold lines.

In a preferred embodiment, the slide means cooperates with the guide tracks for moving the non-projectable fold lines of the flexible window shade to any selected position of adjustment relative to the guide tracks in free-sliding fashion while at the same time maintaining the non-projectable fold lines of the flexible window shade in the plane defined by the guide tracks. In this manner, only the retention means at opposite ends of the flexible window shade need be moved relative to the guide tracks to move the entire flexible window shade in accordian-like fashion from a closed position covering the window to an open position revealing the window with the ends of the flexible window shade then in close proximity at any point along the guide tracks, as desired.

Other objects, advantages and features of the present invention will become apparent from a consideration of the following specification taken in conjunction with the accompanying drawings.

DETAILED DESCRIPTION OF THE PREFERRED EMBODIMENTS

Figure 1:
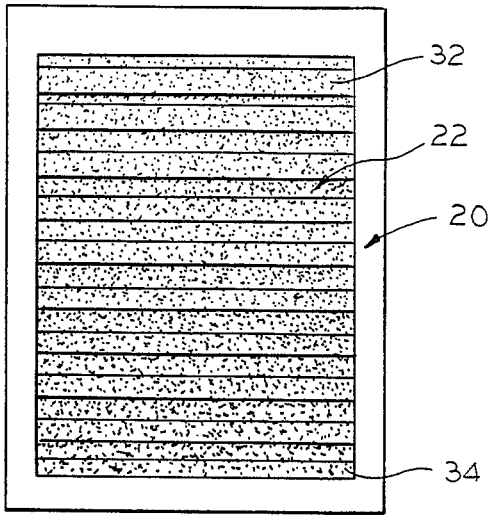
FIG. 1 is a front elevational view of a window shade assembly in accordance with the present invention with the window shade in a fully closed position.
Figure 2:
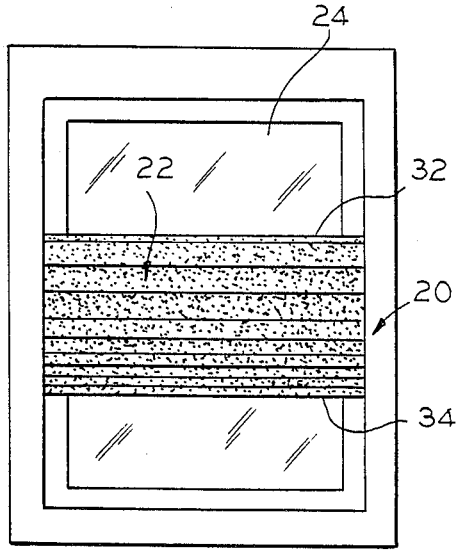
FIG. 2 is a front elevational view similar to FIG. 1 but with the shade partially opened intermediate the top and bottom of a window.
Figure 3:
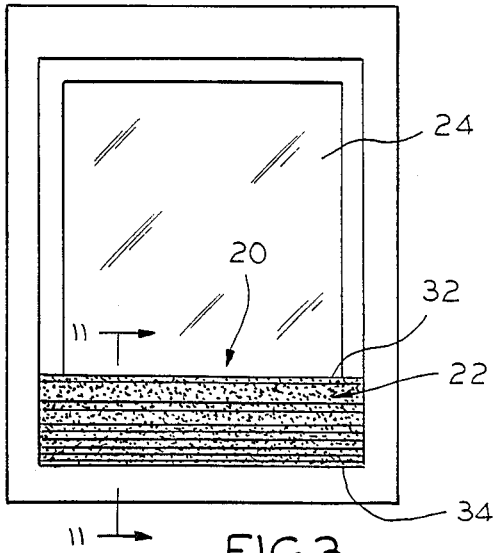
FIG. 3 is a front elevational view similar to FIG. 1 with the window shade substantially completely opened at the bottom of the window.
Figure 4:
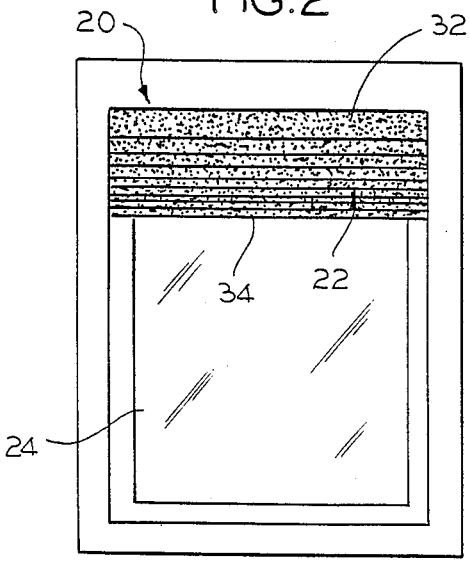
FIG. 4 is a front elevational view similar to FIG. 1 with the window shade substantially completely opened at the top of the window.
Figure 5:
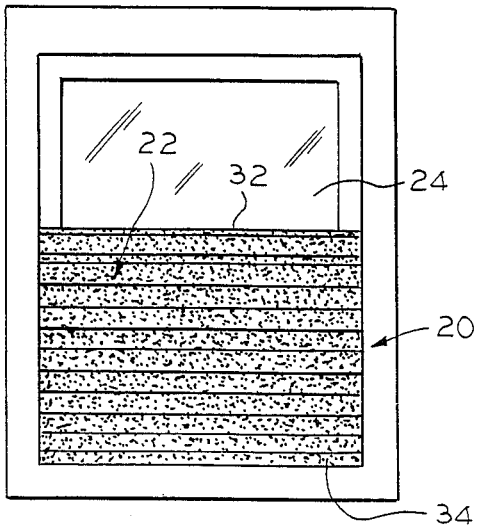
FIG. 5 is a front elevational view similar to FIG. 1 with the window shade opened only at the top of the window.

Referring to the drawings, and first to FIG. 1, the reference numeral 20 designates generally a window shade assembly in accordance with the present invention. The window shade assembly 20 includes a flexible window shade 22 sized to cover a window 24 (see FIG. 2) and formed to have a plurality of pleats 26 therein (see FIGS. 7 and 11). Each of the pleats 26 is defined by a first fold portion 28 and a second fold portion 30 which together form a double fold. The window shade assembly 20 is also formed to have the pleats 26 substantially from one end 32 to the other end 34 of the flexible window shade 22. As shown in FIGS. 1–5, the flexible window shade 22 can entirely cover the window 24, can partially cover the window 24 (FIGS. 2 and 5), or can be substantially entirely opened to reveal almost all of the window 24 (FIGS. 3 and 4).

Figure 6:
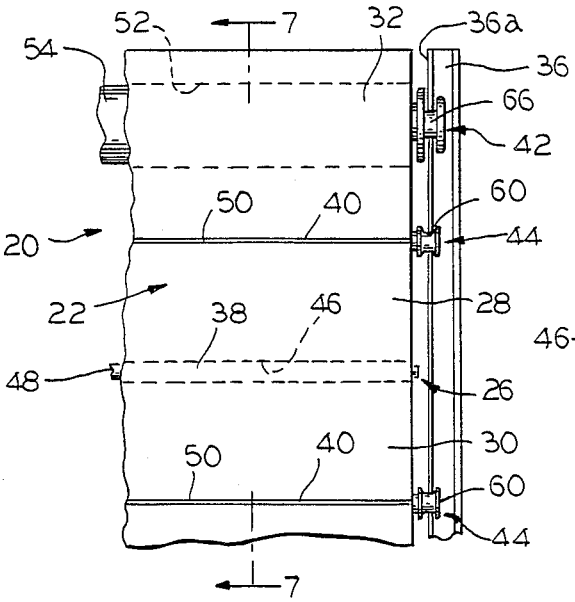
FIG. 6 is a partial front elevational view, partially in section, illustrating the window shade assembly in accordance with the present invention.
Figure 8:
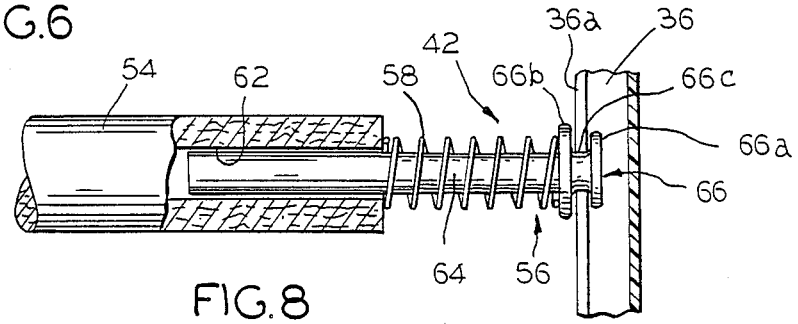
FIG. 8 is a front elevational view, partially in section, of one embodiment of retention means in accordance with the present invention.
Figure 10:
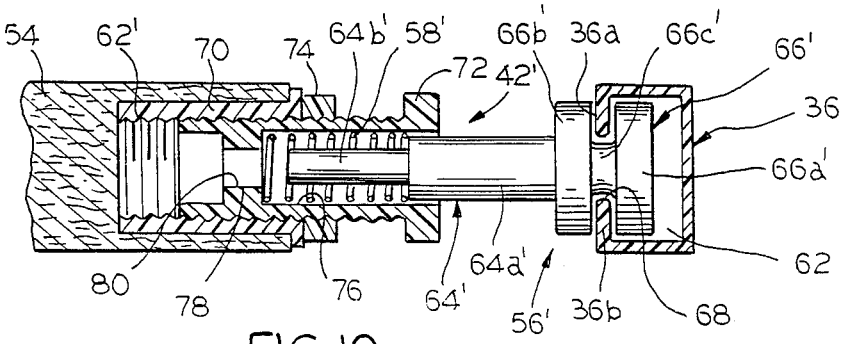
FIG. 10 is across-sectional view of an assembled form of the retention means illustrated in FIG. 9.
Figure 12:
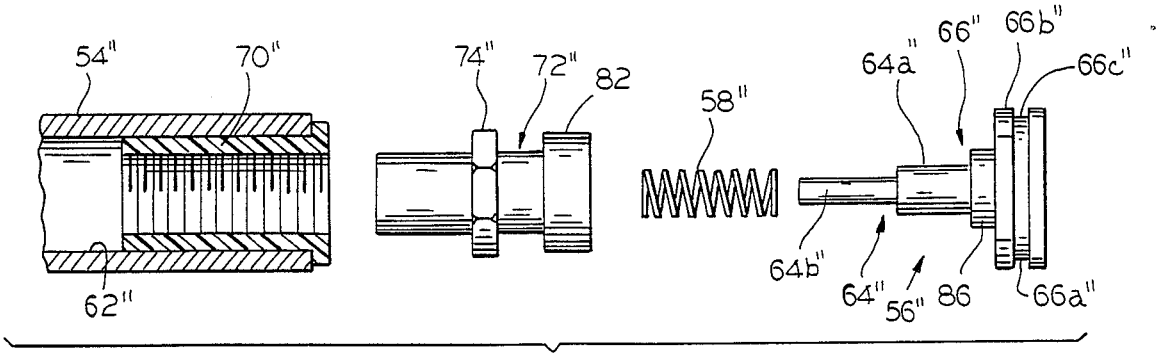
FIG. 12 is an exploded front elevational view, partially in section, of still another embodiment of retention means in accordance with the present invention.

Referring to FIGS. 6, 8 and 10, the window shade assembly 20 will include a pair of guide tracks 36 adapted to be fixedly mounted in spaced parallel relation to a frame of the window 24. More particularly, the guide tracks (such as 36) are adapted to be mounted vertically in the window 24 illustrated in FIGS. 1–5 so as to extend generally perpendicular to the longitudinal (or horizontal) direction of the pleats 26. As will be appreciated by referring to FIG. 6, illustrating one side of a window shade assembly 20, the guide tracks 36 are also adapted to be spaced by a distance sufficient for positioning the pleats 26 therebetween.

Figure 7:
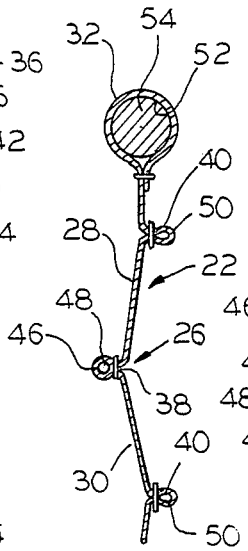
FIG. 7 is a cross-sectional view taken on the line 7—7 of FIG. 6.
Figure 11:
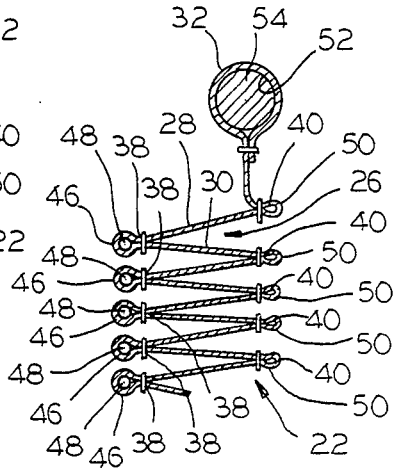
FIG. 11 is a cross-sectional view taken on the line 11—11 of FIG. 3.

As shown in FIGS. 7 and 11, each of the pleats 26 has a projectable fold line 38 between the first and second fold portions 28 and 30 forming the double fold thereof. The projectable fold line 38 is movable from a position generally corresponding to a plane defined by the guide tracks 36 (as shown in FIGS. 6 and 7) when the flexible window shade 22 is closed (as shown in FIG. 1) to cover the window 24 to positions gradually increasing in distance therefrom to a maximum projecting position (as shown in FIG. 11) as the flexible window shade 22 is substantially completely opened (as shown in FIGS. 3 and 4) to most fully reveal the window 24. Further, each of the pleats 26 also is integrally associated by means of a non-projectable fold line 40 with the next adjacent of the pleats 26.

As will be appreciated by referring to FIG. 8, the window shade assembly 20 also includes retention means generally designated 42 which are associated with the ends 32 and 34 of the flexible window shade 22. The retention means 42 are adapted to cooperate with the guide tracks 36 to maintain the ends 32 and 34 of the flexible window shade 22 in any selected position of adjustment relative to the guide tracks 36. Furthermore, the window shade assembly 20 includes slide means generally designated 44 (see FIG. 6) which are associated with opposite ends of the non-projectable fold lines 40.

As shown in FIG. 6, the slide means 44 cooperate with the guide tracks 36 for moving the non-projectable fold lines 40 of the flexible window shade 22 to any selected position of adjustment relative to the guide tracks 36 in free-sliding fashion while at the same time maintaining the non-projectable fold lines 40 of the flexible window shade 22 in the plane defined by the guide tracks 36. With this arrangement, the retention means 42 can be moved relative to the guide tracks 36 to move the flexible window shade 22 in accordian-like fashion from a closed position covering the window (FIG. 1) to an open position revealing some or all of the window (FIGS. 2–5) by moving the ends 32 and 34 of the flexible window shade 22 relative to the guide tracks 36 so as to be in close proximity at any point therealong.

Referring to FIG. 7, the window shade assembly 20 preferably includes stiffening means associated with the projectable fold line 38 of each of the pleats 26. In this connection, the flexible window shade 22 is preferably formed of a sheet-like material and the stiffening means is defined by a loop 46 formed in the sheet-like material at each of the projectable fold lines 38. As shown, the loops 46 each are adapted to receive a dowel-like member 48 to further define the stiffening means while giving greater definition to the projectable fold lines 38.

Similarly, the window shade assembly 20 includes stiffening means associated with the non-projectable fold lines 40 between each of the pleats 26. The stiffening means is again at least defined by a loop 50 formed in the sheet-like material at each of the non-projectable fold lines 40. However, for reasons that will become apparent from the discussion hereinafter, it is believed to be unnecessary to utilize a dowel-like member in the loops 50.

Still referring to FIG. 7, the window shade assembly 20 further includes stiffening means associated with the ends 32 and 34 of the flexible window shade 22. The stiffening means are again defined by a loop 52 formed in the sheet-like material at each of the ends 32 and 34 of the flexible window shade 22. As with the loops 46 at the projectable fold lines 38, the loops 52 in the ends 32 and 34 of the flexible window shade 22 are each adapted to receive a suitably sized dowel-like member 54.

As shown in FIG. 8, the retention means 42 include a roller 56 operatively associated with opposite ends of each of the dowel-like members 54. The rollers 56 each are disposed in captured rolling relation within one of the guide tracks 36. As shown, the rollers 56 are also each biased by a spring 58 away from the respective one of the dowels 54 toward the corresponding one of the guide tracks 36.

Referring again to FIG. 6, the slide means 44 include loose-fitting slide members 60 secured to the flexible window shade 22. One of the slide members 60 is secured to each of the opposite ends of each of the non-projectable fold lines 50. Compared with the rollers 56, the slide members 60 are each disposed in captured but freesliding fashion within one of the guide tracks 36.

Referring specifically to FIG. 8, each of the dowels preferably has a bore 62 to receive one of the rollers 56 in each of the opposite ends thereof. More particularly, the rollers 56 each include a spindle portion 64 adapted to be disposed in one of the bores 62 in a loose-fitting fashion for sliding and rolling movement relative thereto. With this arrangement, the rollers 56 also each include a slotted wheel portion 66 adapted to be captured within one of the guide tracks 36.

Referring to FIG. 10, the guide tracks 36 each include a pair of inwardly projecting flanges **36*a* and 36*b* defining a narrowed track opening 68. While another embodiment of roller is illustrated in FIG. 10 and will be described in detail hereinafter, it will be appreciated that the slotted wheel portion 66 of the roller 56 illustrated in FIG. 8 can include a first wheel portion 66*a* adapted to be disposed within the guide track 36 and a second wheel portion 66*b* adapted to be disposed outwardly of the guide track 36. With this arrangement, the slotted wheel portions 66 also each include a slot 66*c* between the first and second wheel portions 66*a* and 66*b* to receive the inwardly projecting flanges 36*a* and 36*b***.

With the arrangement illustrated in FIG. 8, the springs 58 are disposed about the spindle portions 64 of the rollers 56 so as to be disposed between the dowel-like members 54 and the second wheel portions **66*b* to bias the rollers 56 toward the guide tracks 36**.

Figure 9:
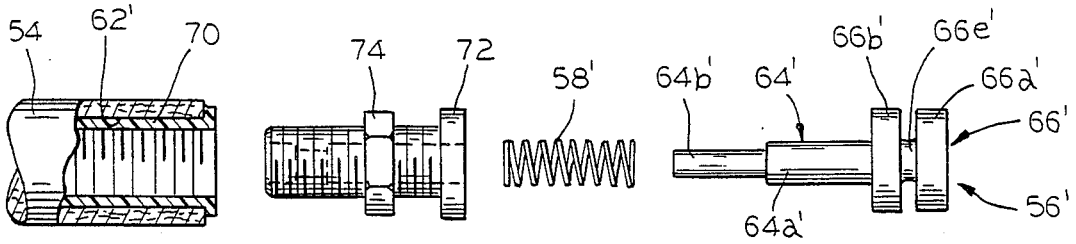
FIG. 9 is an exploded front elevational view, partially in section, of another embodiment of retention means in accordance with the present invention.

In the embodiment illustrated in FIGS. 9 and 10, the window shade assembly 20 includes adjustment means associated with the rollers 56' and the dowel-like members 54. The adjustment means is adapted to vary the extent of projection of the rollers 56' from the dowel-like members 54 to accommodate differences in spacing between the guide tracks 36. In addition, the adjustment means is adapted to vary the force by which the rollers 56' are biased by the springs 58' toward the guide tracks 36.

With the embodiment illustrated in FIGS. 9 and 10, each of the dowels 54 has a bore 62' in opposite ends thereof. The retention means generally designated 42' each include a threaded insert 70 in the bores 62' in the dowel-like members 54 and a threaded roller-receiving extension 72 for threaded engagement with each of the threaded inserts 70. As a result, the threaded roller-receiving extensions 72 are adapted to project at varying distances from the dowel-like members 54.

Preferably, means such as the jam nut 74 are provided for securing the threaded roller-receiving extensions 72 in selected positions of adjustment. The threaded roller-receiving extensions 72 each have a main bore 76 interrupted by an internal shoulder 78 having a smaller bore 80 therethrough. As will be appreciated, the springs 58' are each disposed in the respective one of the main bores 76 to rest against the corresponding internal shoulder 78 where they can act against the respective one of the rollers 56'.

As before, the rollers 56' each include a spindle portion 64' but the spindle portion 64' has a major diameter portion **64*a*' and a minor diameter portion 64*b*'. The major diameter portion 64*a*' is adapted to be disposed in the main bore 76 of the threaded roller-receiving extension 72 in loose fitting fashion for sliding and rolling movement relative thereto and in engagement with the spring 58'. As will be appreciated, the minor diameter portion 64*b*' is adapted to be disposed for movement through the smaller bore 80 when the roller 56' compresses the spring 58' by movement toward the dowel-like member 54**.

While shaped slightly differently, the rollers 56' also each include a slotted wheel portion 66' adapted to be captured within one of the guide tracks 36. It will be seen that the slotted wheel portions 66' will each include a first wheel portion **66*a*' and a second wheel portion 66*b*' as well as a slot 66*c*' therebetween. As before, the inwardly projecting flanges 36*a* and 36*b* will be received within the slot 66*c*' between the first and second wheel portions 66*a*' and 66*b*'**, respectively.

In the preferred embodiment illustrated in FIGS. 12–16, the window shade assembly 20 includes adjustment means associated with the non-rotational sliders 56'' and the conduit-like members 54''. The adjustment means is adapted to vary the extent of projection of the non-rotational sliders 56'' from the conduit-like members 54'' to accommodate differences in spacing between the guide tracks 36. In addition, the adjustment means is adapted to vary the force by which the non-rotational sliders 56'' are biased by the springs 58'' toward the guide tracks 36.

With the preferred embodiment illustrated in FIGS. 12–16, each of the conduit-like members 54'' has a bore 62'' preferably extending entirely therethrough. The retention means generally designated 42'' each include a threaded insert 70'' kick-pressed into the opposite ends of each of the conduit-like members 54'' and a threaded non-rotational slider-receiving extension 72'' for threaded engagement with each of the threaded inserts 70''. As a result, the threaded non-rotational slider-receiving extensions 72'' are adapted to project at varying distances from the conduit-like members 54''.

Preferably, as before, means such as the jam nut 74'' are provided for securing the threaded non-rotational slider-receiving extensions 72'' in selected positions of adjustment. The threaded non-rotational slider-receiving extensions 72'' each have a main bore 76'' interrupted by an internal shoulder 78'' having a smaller bore 80'' therethrough. As will be appreciated, the springs 58'' are each disposed in the respective one of the main bores 76'' to rest against the corresponding internal shoulder 78″ where they can act against the respective one of the non-rotational sliders 56″.

Also as before, the non-rotational sliders 56″ each include a spindle portion 64″ but the spindle portion 64″ has a major diameter portion 64*a*″ and a minor diameter portion 64*b*″. The major diameter portion 64*a*″ is adapted to be disposed in the main bore 76″ of the threaded non-rotational slider-receiving extension 72″ in loose-fitting fashion for sliding movement relative thereto and in engagement with the spring 58″. As will be appreciated, the minor diameter portion 64*b*″ is adapted to be disposed for movement through the smaller bore 80″ when the non-rotational 56″ compresses the spring 58″ by movement toward the conduit-like member 54″.

Unlike the rollers 56′ in FIGS. 9 and 10, the non-rotational sliders 56″ each preferably include a slotted, longitudinally extending H-shaped guide track follower 66″ adapted to be captured within one of the guide tracks 36. It will be seen that the H-shaped guide track followers 66″ will each include a first follower portion 66*a*″ and a second follower portion 66*b*″ as well as a longitudinally extending slot 66*c*″ therebetween. As before, the inwardly projecting flanges 36*a* and 36*b* of the guide track 36 will be received within the longitudinally extending slot 66*c*″ between the first and second follower portions 66*a*″ and 66*b*″, respectively.

By reason of the longitudinal extent of the H-shaped guide track followers 66″, the ends 32 and 34 of the window shade assembly 20 can only be moved relative to the guide tracks 36 in a manner whereby they remain generally horizontal in the embodiment illustrated in FIGS. 12–16. This is largely insured by maintaining appropriate tolerances between the flanges 36*a* and 36*b* and the slots 66*c*″ whereby positioning of H-shaped guide track followers 66″ in other than a generally horizontal plane is essentially precluded. Of course, this is also controlled in the embodiment illustrated in FIGS. 12–16 by maintaining appropriate tolerances between the spindle portions 64″ of the non-rotational sliders 56″ and the bores 76″ in the threaded non-rotational slider-receiving extensions 72.

Figure 13:
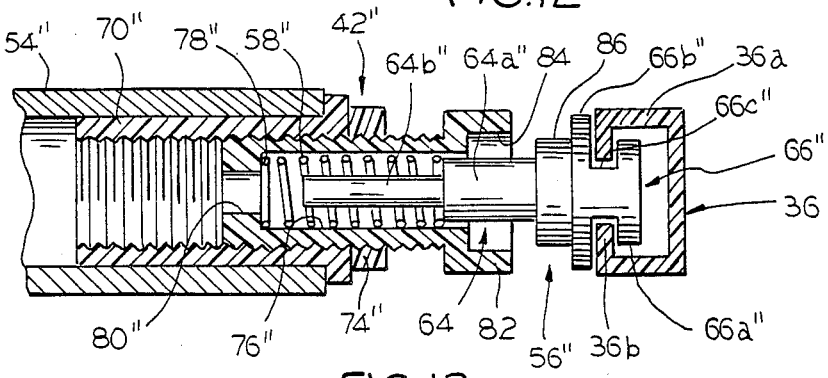
FIG. 13 is a cross-sectional view of an assembled form of the retention means illustrated in FIG. 12.
Figure 14:
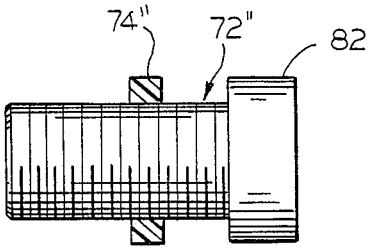
FIG. 14 is a side elevational view of an assembled form of the retention means illustrated in FIG. 12.
Figure 15:
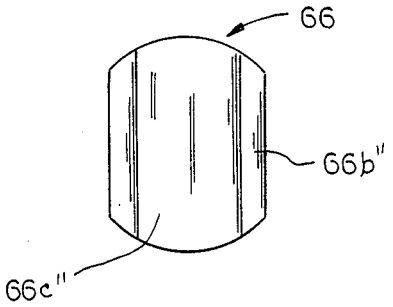
FIG. 15 is a front elevational view of a non-rotational slider of the retention means illustrated in FIG. 12.
Figure 16:
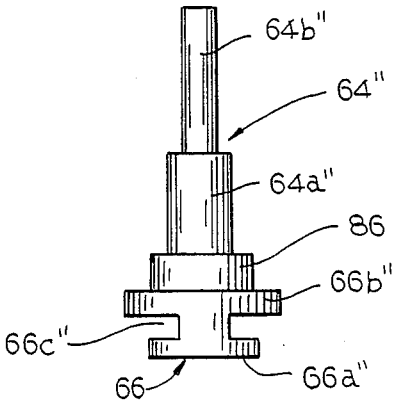
FIG. 16 is a top plan view of the non-rotational slider of the retention means illustrated in FIG. 12.

As perhaps best shown in FIG. 13, the threaded non-rotational slider-receiving extension 72″ is formed in a manner somewhat different from the threaded roller-receiving extension 72. It will be seen, in particular, that the threaded non-rotational slider-receiving extension 72″ includes an enlarged cylindrical projection 82 having a bore 84 greater in diameter than the main bore 76″ so as to receive a cylindrical boss 86 of substantially the same diameter therewithin. By once again controlling the tolerances of the bore 84 in the enlarged cylindrical projection 82 and the cylindrical boss 86, this additional structure adds further stability to insure maintaining the ends 32 and 34 of the window shade assembly 20 in a generally horizontal plane in the embodiment illustrated in FIGS. 12–16.

With the present invention, a truly versatile window shade assembly which is particularly advantageous for a vertically raised and lowered shade which can also be mounted for horizontally opened and closed shade operation has been successfully provided. It is possible with this window shade assembly to position a flexible window shade in any of an essentially infinite variety of positions from one completely covering a window to one substantially entirely revealing the window with the shade at either the top or bottom thereof (when mounted for vertical operation as illustrated in the drawings) or at any intermediate position relative to the top or bottom of the window with any extent of the window revealed. In addition, the window shade assembly is environmentally more sound, aesthetically more pleasing, and functionally far superior to any previously available window shade.

While in the foregoing there have been set forth preferred embodiments of the invention, it will be appreciated that the details herein given may be varied without departing from the spirit and scope of the appended claims.

I claim:

1. A window shade assembly, comprising:

a flexible window shade sized to cover a window and formed to have a plurality of pleats therein, each of said pleats being defined by a first fold portion and a second fold portion which together form a double fold, said flexible window shade being formed to have said pleats substantially from one end to the other end thereof;

a pair of guide tracks to be fixedly mounted to a frame of said window in spaced parallel relation, said guide tracks to extend generally perpendicular to the longitudinal direction of said pleats, said guide tracks also to be spaced by a distance sufficient for positioning said pleats therebetween;

each of said pleats having a projectable fold line between said first and second fold portions forming said double fold thereof, said projectable fold lines being movable from positions generally corresponding to a plane defined by said guide tracks when said flexible window shade is closed to cover said window to positions gradually increasing in distance therefrom to maximum projecting positions as said flexible window shade is opened to reveal said window, each of said pleats also being integrally associated by means of a non-projectable fold line with the next adjacent of said pleats; and retention means associated with each of said ends of said flexible window shade, said retention means being adapted to operate in cooperation with said guide tracks in a manner providing a resistance to movement only for said ends of said flexible window shade sufficient to maintain at least one of said ends of said window shade in any selected position of adjustment relative to said guide tracks, and slide means associated with opposite ends of every one of said non-projectable fold lines;

said slide means cooperating with said guide tracks for moving said non-projectable fold lines of said flexible window shade relative thereto, said slide means comprising loose fitting slide members secured to said flexible window shade, one of said slide members being secured to each of said opposite ends of said non-projectable fold lines, said slide members also each being disposed in captured free-sliding fashion within one of said guide tracks so as to facilitate free-sliding movement of said flexible window shade inwardly of said ends thereof for positioning said flexible window shade in any selected position of adjustment relative to said guide tracks in accordian-like fashion, said slide members maintaining said non-projectable fold lines of said flexible window shade in said plane defined by said guide tracks;

whereby said retention means can be moved relative to said guide tracks to move said flexible window shade in accordian-like fashion from a closed position covering said window to an open position revealing said window by moving at least one of said ends of said flexible window shade against resistance to movement of said retention means relative to said guide tracks so as to be in close proximity at any point therealong.

2. The window shade assembly as defined by claim 1 including stiffening means associated with said projectable fold line of each of said pleats, said flexible window shade being formed of a sheet-like material, said stiffening means being defined by a loop formed in said sheet-like material at each of said projectable fold lines.

3. The window shade assembly as defined by claim 2 wherein each of said loops in said sheet-like material is adapted to receive a dowel-like member, and including a dowel-like member in each of said loops in said sheet-like material to further define said stiffening means.

4. The window shade assembly as defined by claim 1 including stiffening means associated with said non-projectable fold lines between each of said pleats, said flexible window shade being formed of a sheet-like material, said stiffening means being defined by a loop formed in said sheet-like material at each of said non-projectable fold lines.

5. The window shade assembly as defined by claim 1 including stiffening means associated with said ends of said flexible window shade, said flexible window shade being formed of a sheet-like material, said stiffening means being defined by a loop formed in said sheet-like material at said ends of said flexible window shade.

6. The window shade assembly as defined by claim 5 wherein each of said loops in said sheet-like material is adapted to received a dowel-like member, and including a dowel-like member in each of said loops in said sheet-like material to further define said stiffening means.

7. The window shade assembly as defined by claim 6 wherein said retention means includes a roller operatively associated with opposite ends of each of said dowel-like members, said rollers each being disposed in captured rolling relation within one of said guide tracks, said rollers also each being biased by a spring away from the respective one of said dowel-like members toward the corresponding one of said guide tracks.

8. The window shade assembly as defined by claim 6 wherein said retention means includes a non-rotational slider operatively associated with opposite ends of each of said dowel-like members, said dowel-like members comprising conduit-like members and said non-rotational sliders each being disposed in captured sliding relation within one of said guide tracks, said non-rotational sliders also each including a spring applying a relative biasing force between the respective one of said conduit-like members and said guide tracks.

9. A window shade assembly, comprising:

a flexible window shade sized to cover a window and formed to have a plurality of pleats therein, said flexible window shade being formed of a sheet-like material and each of said pleats being defined by a first fold portion and a second fold portion which together form a double fold, said flexible window shade being formed to have said pleats substantially from one end to the other end thereof;

a pair of guide tracks to be fixedly mounted to a frame of said window in spaced parallel relation, said guide tracks to extend generally perpendicular to the longitudinal direction of said pleats, said guide tracks also to be spaced by a distance sufficient for positioning said pleats therebetween;

each of said pleats having a projectable fold line between said first and second fold portions forming said double fold thereof, said projectable fold lines being movable from positions generally corresponding to a plane defined by said guide tracks when said flexible window shade is closed to cover said window to positions gradually increasing in distance therefrom to maximum projecting positions as said flexible window shade is opened to reveal said window, each of said pleats also being integrally associated by means of a non-projectable fold line with the next adjacent of said pleats;

stiffening means associated with said projectable fold lines of said pleats, said stiffening means being defined by a loop formed in said sheet-like material at each of said projectable fold lines;

stiffening means associated with said non-projectable fold lines between each of said pleats, said stiffening means being defined by a loop formed in said sheet-like material at each of said non-projectable fold lines;

stiffening means associated with said ends of said flexible window shade, said stiffening means being defined by a loop formed in said sheet-like material at each of said ends of said flexible window shade;

retention means associated with said ends of said flexible window shade, said retention means being adapted to operate in cooperation with said guide tracks in a manner providing a resistance to movement only for said ends of said flexible window shade relative to said guide tracks sufficient to maintain both of said ends of said flexible window shade in any selected position of adjustment relative to said guide tracks, and slide means associated with opposite ends of every one of said non-projectable fold lines;

said slide means cooperating with said guide tracks for moving said non-projectable fold lines of said flexible window shade, said slide means comprising slide members captured in free-sliding fashion within said guide tracks so as to facilitate free-sliding movement of said flexible window shade inwardly of said ends thereof for positioning said flexible window shade in any selected position of adjustment relative to said guide tracks in accordian-like fashion, said slide members maintaining said non-projectable fold lines of said flexible window shade in said plane defined by said guide tracks;

each of said loops in said sheet-like material at each of said ends of said flexible window shade being adapted to receive a dowel-like member, and including a dowel-like member in each of said loops in said sheet-like material at each of said ends of said flexible window shade to further define said stiffening means;

said retention means including a roller operatively associated with opposite ends of each of said dowel-like members in each of said loops at said ends of said flexible window shade, said rollers each being disposed in captured rolling relation within one of said guide tracks, said rollers also each being biased by a spring away from the respective one of said dowel-like members toward the corresponding one of said guide tracks;

one of said slide members being secured to each of said opposite ends of said non-projectable fold lines;

whereby said rollers can be moved relative to said guide tracks to move said flexible window shade in accordian-like fashion from a closed position covering said window to an open position revealing said window by moving said ends of said flexible window shade against resistance to movement of said retention means relative to said guide tracks so as to be in close proximity at any point therealong.

10. The window shade assembly as defined by claim 9 wherein each of said loops in said sheet-like material at said projectable fold lines is adapted to receive one of said dowel-like members, and including a dowel-like member in each of said loops in said sheet-like material at said projectable fold lines to further define said stiffening means.

11. The window shade assembly as defined by claim 9 wherein each of said dowel-like members has a bore in opposite ends thereof, said rollers each including a spindle portion adapted to be disposed in one of said bores in loose-fitting fashion for sliding and rolling movement relative thereto, said rollers also each including a slotted wheel portion adapted to be captured within one of said guide tracks.

12. The window shade assembly as defined by claim 11 wherein said guide tracks each include a pair of inwardly projecting flanges defining a narrowed track opening, said slotted wheels each including a first wheel portion adapted to be disposed within said guide track and a second wheel portion adapted to be disposed outwardly of said guide track, said slotted wheels also each including a slot between said first and second wheel portions to receive said inwardly projecting flanges.

13. The window shade assembly as defined by claim 12 wherein said springs are disposed about said spindle portions of said rollers so as to be disposed between said dowel-like members and said second wheel portions to bias said rollers towards said guide tracks.

14. The window shade assembly as defined by claim 9 including adjustment means associated with said rollers and said dowel-like members, said adjustment means being adapted to vary the extent of projection of said rollers from said dowel-like members to accommodate differences in spacing between said guide tracks, said adjustment means also being adapted to vary the force by which said rollers are biased by said springs toward said guide tracks.

15. The window shade assembly as defined by claim 14 wherein each of said dowel-like members has a bore in opposite ends thereof, said retention means including a threaded insert in each of said bores in said dowel-like members and a threaded roller receiving extension for threaded engagement with each of said threaded inserts, said threaded roller receiving extensions being adapted to project at varying distances from said dowel-like members.

16. The window shade assembly as defined by claim 15 including means for securing said threaded roller receiving extensions in selected positions of adjustment, said threaded roller receiving extensions each having a main bore interrupted by an internal shoulder having a smaller bore therethrough, said spring being disposed in said main bore to rest against said internal shoulder.

17. The window shade assembly as defined by claim 16 wherein said rollers each include a spindle portion having a major and a minor diameter portion, said major diameter portion being adapted to be disposed in said main bore of said threaded roller receiving extension in loose-fitting fashion for sliding and rolling movement relative thereto and in engagement with said spring, said minor diameter portion being adapted to be disposed for movement through said smaller bore when said roller compresses said spring by movement toward said dowel-like member.

18. The window shade assembly as defined by claim 9 wherein said rollers each include a slotted wheel portion adapted to be captured within one of said guide tracks, said guide tracks each including a pair of inwardly projecting flanges defining a narrow track opening, said slotted wheel portions each including a first wheel portion adapted to be disposed within said guide track and a second wheel portion adapted to be disposed outwardly of said guide track, said slotted wheel portions also each including a slot between said first and second wheel portions to receive said inwardly projecting flanges.

19. A window shade assembly, comprising:

a flexible window shade sized to cover a window and formed to have a plurality of pleats therein, said flexible window shade being formed of a sheet-like material and each of said pleats being defined by a first fold portion and a second fold portion which together form a double fold, said flexible window shade being formed to have said pleats substantially from one end to the other end thereof;

a pair of guide tracks to be fixedly mounted to a frame of said window in spaced parallel relation, said guide tracks to extend generally perpendicular to the longitudinal direction of said pleats, said guide tracks also to be spaced by a distance sufficient for positioning said pleats therebetween;

each of said pleats having a projectable fold line between said first and second fold portions forming said double fold thereof, said projectable fold line being movable from a position generally corresponding to a plane defined by said guide tracks when said flexible window shade is closed to cover said window to positions gradually increasing in distance therefrom to a maximum projecting position as said flexible window shade is opened to reveal said window, each of said pleats also being integrally associated by means of a non-projectable fold line with the next adjacent of said pleats;

stiffening means associated with said projectable fold lines of each of said pleats, said stiffening means being defined by a loop formed in said sheet-like material at each of said projectable fold lines;

stiffening means associated with said non-projectable fold lines between each of said pleats, said stiffening means being defined by a loop formed in said sheet-like material at each of said non-projectable fold lines;

stiffening means associated with said ends of said flexible window shade, said stiffening means being defined by a loop formed in said sheet-like material at said ends of said flexible window shade;

retention means associated with said ends of said flexible window shade, said retention means being adapted to operate in cooperation with said guide tracks in a manner providing a resistance to movement only for said ends of said flexible window shade relative to said guide tracks sufficient to maintain both of said ends of said flexible window shade in any selected position of adjustment relative to said guide tracks, and slide means associated with opposite ends of every one of said non-projectable fold lines;

said slide means cooperating with said guide tracks for moving said non-projectable fold lines of said flexible window shade, said slide means comprising slide members captured in free-sliding fashion within said guide tracks so as to facilitate free-sliding movement of said flexible window shade inwardly of said ends thereof for positioning said flexible window shade in any selected position of adjustment relative to said guide tracks in accordian-like fashion, said slide members maintaining said non-projectable fold lines of said flexible window shade in said plane defined by said guide tracks;

each of said loops in said sheet-like material at each of said ends of said flexible window shade being adapted to receive a dowel-like member, and including a dowel-like member in each of said loops in said sheet-like material at each of said ends of said flexible window shade to further define said stiffening means;

said retention means including a non-rotational slider operatively associated with opposite ends of each of said dowel-like members in each of said loops at said ends of said flexible window shade, said dowel-like members comprising conduit-like members and said non-rotational sliders each being disposed in captured sliding relation within one of said guide tracks, said non-rotational sliders also each being biased by a spring away from the respective one of said conduit-like members toward the corresponding one of said guide tracks;

one of said slide members being secured to each of said opposite ends of said non-projectable fold lines;

whereby said non-rotational sliders can be moved relative to said guide tracks to move said flexible window shade in accordian-like fashion from a closed position covering said window to an open position revealing said window by moving said ends of said flexible window shade against resistance to movement of said retention means relative to said guide tracks so as to be in close proximity at any point therealong.

20. The window shade assembly as defined by claim 19 wherein each of said loops in said sheet-like material at said projectable fold lines is adapted to receive one of said conduit-like members, and including a conduit-like member in each of said loops in said sheet-like material at said projectable fold lines to further define said stiffening means.

21. The window shade assembly as defined by claim 19 wherein each of said conduit-like members has a bore extending therethrough, said non-rotational sliders each including a spindle portion adapted to be disposed in one of said bores for sliding movement relative thereto, said non-rotational sliders also each including a slotted longitudinally extending H-shaped guide track follower adapted to be captured within one of said guide tracks.

22. The window shade assembly as defined by claim 21 wherein said guide tracks each include a pair of inwardly projecting flanges defining a narrowed track opening, said H-shaped guide track followers each including a first follower portion adapted to be disposed within said guide track and a second follower portion adapted to be disposed outwardly of said guide track, said H-shaped guide track followers also each including a slot between said first and second follower portions to receive said inwardly projecting flanges.

23. The window shade assembly as defined by claim 19 including adjustment means associated with said non-rotational sliders and said conduit-like members, said adjustment means being adapted to vary the extent of projection of said non-rotational sliders from said conduit-like members to accommodate differences in spacing between said guide tracks, said adjustment means also being adapted to vary the force by which said non-rotational sliders are biased by said springs toward said guide tracks.

24. The window shade assembly as defined by claim 23 wherein each of said conduit-like members has a bore extending therethrough, said retention means including a threaded insert in each of the opposite ends of each of said conduit-like members and a threaded non-rotational slider-receiving extension for threaded engagement with each of said threaded inserts, said threaded non-rotational slider-receiving extensions being adapted to project at varying distances from said conduit-like members.

25. The window shade assembly as defined by claim 24 including means for securing said threaded non-rotational slider-receiving extensions in selected positions of adjustment, said threaded non-rotational slider-receiving extensions each having a main bore interrupted by an internal shoulder having a smaller bore therethrough, said spring being disposed in said main bore to rest against said internal shoulder.

26. The window shade assembly as defined by claim 25 wherein said non-rotational sliders each include a spindle portion having a major and a minor diameter portion, said major diameter portion being adapted to be disposed in said main bore of said threaded non-rotational slider-receiving extension for sliding movement relative thereto and in engagement with said spring, said minor diameter portion being adapted to be disposed for movement through said smaller bore when said non-rotational slider compresses said spring by movement toward said conduit-like member.

27. The window shade assembly as defined by claim 26 wherein said threaded non-rotational slider-receiving extensions each include an enlarged cylindrical projection, said non-rotational sliders each including a cylindrical boss adapted to be disposed within a bore in said enlarged cylindrical projection of one of said threaded non-rotational slider-receiving extensions.

28. The window shade assembly as defined by claim 19 wherein said non-rotational sliders each include a slotted longitudinally extending H-shaped guide track follower adapted to be captured within one of said guide tracks, said guide tracks each including a pair of inwardly projecting flanges defining a narrow track opening, said guide track followers each including a first follower portion adapted to be disposed within said guide track and a second follower portion adapted to be disposed outwardly of said guide track, said H-shaped guide track followers also each including a slot between said first and second follower portions to receive said inwardly projecting flanges.

* * * * *